United States Patent [19]

Reeves

[11] Patent Number: 4,491,276

[45] Date of Patent: Jan. 1, 1985

[54] ELECTROSTATIC SPRAY APPARATUS

[75] Inventor: Clarence C. Reeves, Houston, Tex.

[73] Assignee: Speeflo Manufacturing Corporation, Houston, Tex.

[21] Appl. No.: 395,143

[22] Filed: Jul. 6, 1982

[51] Int. Cl.[3] ..... B05B 5/02

[52] U.S. Cl. ..... 239/692; 290/1 R; 290/43; 361/228; 415/123; 415/202

[58] Field of Search ..... 239/690, 692, 703; 290/1 R, 43; 415/123, 202; 361/227, 228

[56] References Cited

U.S. PATENT DOCUMENTS

| | | | |
|---|---|---|---|
| 1,307,703 | 6/1919 | Middelthan et al. | 415/123 |
| 1,600,346 | 9/1926 | MacMurchy | 415/123 |
| 3,386,702 | 6/1968 | Krzyszczuk | 415/123 |
| 4,219,865 | 8/1980 | Malcolm | 361/228 |
| 4,290,091 | 9/1981 | Malcolm | 361/228 |
| 4,377,838 | 3/1983 | Levey et al. | 361/228 |

FOREIGN PATENT DOCUMENTS

| | | | |
|---|---|---|---|
| 2082940 | 3/1982 | United Kingdom . | |
| 537191 | 12/1976 | U.S.S.R. | 415/123 |

*Primary Examiner*—Andres Kashnikow

*Attorney, Agent, or Firm*—Pearne, Gordon, Sessions, McCoy, Granger & Tilberry

[57] ABSTRACT

A pneumatic system is disclosed for regulating the acceleration and running speed of an air turbine and alternator used in electrostatic spray apparatus having a self-contained electrical power supply. The air turbine includes a rotor which is arranged to be biased in a first direction of rotation by a flow of impinging drive air and in a second opposite direction by a flow of impinging brake air. The flows of air cooperatively result in rotation of the turbine in a desired direction of operation and enable a minimized period of acceleration for a predetermined running speed.

17 Claims, 5 Drawing Figures

Fig. 4
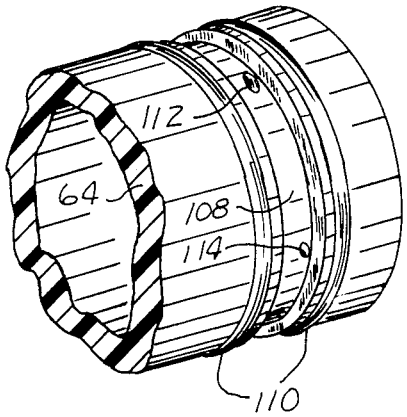
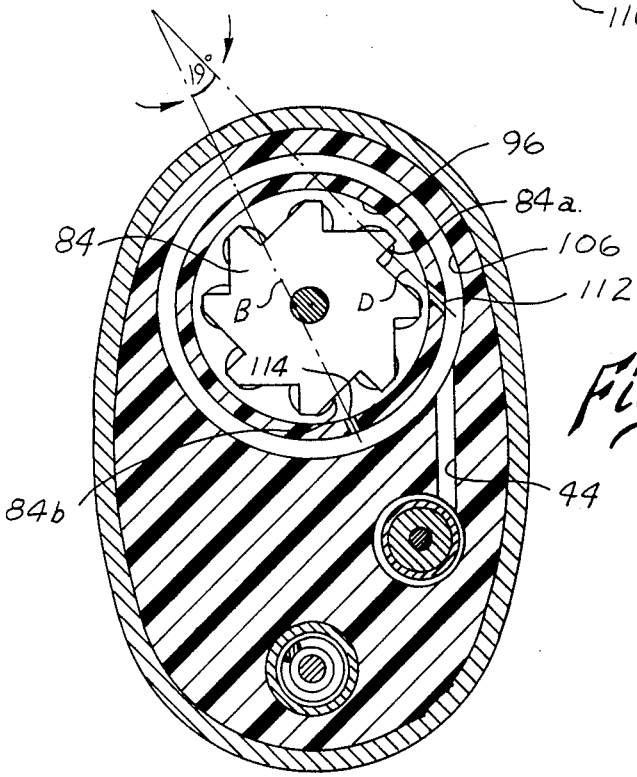
Fig. 3
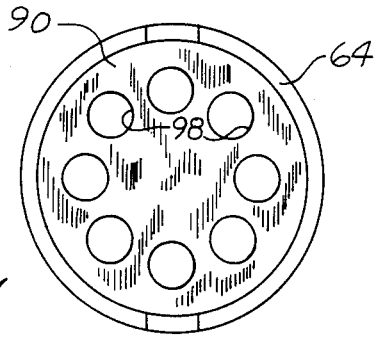
Fig. 5

ELECTROSTATIC SPRAY APPARATUS

BACKGROUND OF THE INVENTION AND PRIOR ART

This invention relates to electrostatic spray apparatus, and more particularly to electrostatic spray apparatus including a self-contained energy conversion system adapted to convert the energy of a fluid under pressure into electrical energy for electrostatic spraying.

The type of spray apparatus of concern herein is disclosed in U.S. Pat. Nos. 4,219,865 and 4,290,090, each to Malcolm, and U.S. Pat. No. 4,377,838 to Levey et al. The teachings of each of the foregoing patents and patent application are incorporated herein by reference.

In the prior energy conversion systems, an air motor and a directly driven alternator provide an electrical power signal which is modified by downstream electrical components to provide a final electrical potential suitable for application to the electrode of the spray apparatus. The air motors are impulse-type motors or turbines having a rotor which is driven by an impinging air flow. In accordance with a preselected air flow to the spray apparatus, the air motor and alternator are designed to accelerate in a minimum period of time to a steady state or final running speed such that the electrical power signal from the alternator is suitable for conversion to the required electrostatic spray potential by the downstream electrical components. The period of acceleration should be minimized in order to enable prompt spraying at the full electrostatic potential upon actuation of the spray apparatus.

The design of energy conversion systems to provide proper acceleration and running speed characteristics has comprised heretofore essentially a design trade-off or balancing problem with rapid acceleration being accompanied by high running speeds and correspondingly increased electrical power signals. Thus, a desired acceleration period was associated with a unique running speed for a given system, and the downstream electrical components were, hopefully, economically matched to the electrical power signal from the alternator. The Malcolm and Levey et al. electrical components are described below in illustration of such prior art efforts.

In the Malcolm apparatus, the turbine is operated at a running speed of about 10,000 to 15,000 rpm, and the alternator produces about 15 volts, and this power signal is rectified. The rectified signal operates an oscillator which is operating at about 20 kilohertz at 12 volts. The oscillator has a square wave output which can be multiplied in a toroidal transformer to a value of about 2500 volts. This signal is then multiplied by a conventional cascade half-wave voltage multiplier of about 20 stages to produce a normal 50–55 kilovolt output. The cascade multiplier is a half-wave rectifier, and this oscillator-to-multiplier system is designed to produce the 55 kilovolt voltage as a DC voltage with a minimum of ripple voltage or peak.

It has been observed that the Malcolm circuitry just described, necessary for the conversion of low-voltage, low-frequency, e.g., 250 Hz at 12 volts, into high frequency and higher voltage, e.g., 20 KHz at 2500 volts, is subject to overheating and breakdown of the components when they have been miniaturized sufficiently for installation in a hand-manipulable spray apparatus. These latter problems are believed to be related to the fact that the air flow needed to provide the required acceleration in the Malcolm device results in a running speed and alternator voltage greater than desired. Consequently, the electrical restriction of the voltage to the desired 12-to-15 volts produces excess heat, which precludes continuous duty service without damage to the electrical components.

The Levey et al. spray apparatus is an improvement over the Malcolm apparatus and, in fact, adopts a significantly different operating approach since Levey et al. teach the use of a direct voltage having an alternating voltage ripple in excess of 15%. To that end, Levey et al. teach a simplified electrical apparatus which includes an air turbine operable from an external air supply at a speed in the order of 60,000 rpm, a directly coupled alternator to generate an alternating voltage in the order of 50 volts at about 1000 Hz, a step-up transformer connected to the alternator to transform the voltage thereof into a secondary voltage in the order of 2500 volts, and a long chain series voltage multiplier connected to the transformer to increase the voltage thereof to one in the order of 55–80 Kv.

The Levey et al. device resolves the overheating and breakdown problems in the Malcolm device substantially through elimination of certain of the electronic circuitry and incorporation of components of longer life which are less subject to premature failure. However, the Levey et al. device requires careful attention in respect to the physical dimensions of the turbine and alternator arrangement, as well as the pressure and volume flow of the driving air. The prior art energy conversion systems tend to be overly sensitive to variations in the supply of driving air. For example, moderate increases in pressure may cause overspeed of the turbine and alternator and corresponding excessive electrical loads that are damaging to the system. On the other hand, decreases in the pressure will result in unacceptably long acceleration periods before a suitable spray potential is applied to the electrode, as well as steady state operation at a lower than desirable potential with correponding decreases in the efficiency of the spraying. In addition to such variations in the pressure of the supplied air, the spray apparatus itself may be intermittently altered from an operating mode, wherein the delivered air flow is divided between a spray cap and the turbine, to a condition with the full air flow being delivered to the turbine.

SUMMARY OF THE INVENTION

The energy conversion system of the present invention provides an improved pneumatic technique for regulating the acceleration and the running speed of the turbine. In accordance with the invention, a pneumatic drive and a pneumatic brake are arranged to cooperatively accelerate the turbine from rest to a predetermined running speed in a predetermined time interval or acceleration period. In contrast with prior art systems, the provision of both drive and brake functions substantially eliminates the strict correspondence between acceleration and running speed for a given air supply to the spray apparatus. The pneumatic drive and brake arrangement enables independent selection of a desired acceleration period and a desired running speed within value ranges useful for purposes of electrostatic spraying. Typically, the drive and brake arrangements are used to limit the running speed to a value lower than the value resulting for the same acceleration period using prior art techniques and devices.

In typical electrostatic spray apparatus, the energy conversion system is used to provide a minimum acceleration period, effectively instantaneous, and to limit the running speed to values which provide electrical power signals consistent with the electronic circuitry. Thus, the rapid acceleration periods of one second or less necessary for immediate electrostatic spraying are attained without undue burden upon the electronic circuitry.

In the illustrated embodiment, the pneumatic drive and brake are provided by a drive flow of air impinging upon the turbine to drive it in a first direction of rotation and a brake flow of air impinging upon the turbine to drive it in an opposite second direction of rotation. The flows of drive and brake air are derived from a common manifold chamber which is connected to a remote source of air under pressure, such as that typically available in industrial plants.

The drive and brake flows of air are respectively impinged upon the turbine, and, more particularly, the turbine rotor, to bias the rotation thereof in opposite directions. The flow of drive air impinged upon the rotor is greater than the flow of brake air impinged upon the rotor. It has been found that for a given drive flow, an increase in the brake flow will result in a lower running speed without substantial effect upon the acceleration. Thus, essentially instantaneous acceleration (e.g., one second or less) may be provided with selection of a desired running speed. In this manner, the energy conversion system as a whole may be efficiently matched with the electronic circuitry. Moreover, the overheating and breakdown problems encountered in connection with prior art spray apparatus are substantially eliminated.

The energy conversion system of the present invention has been found to be less sensitive to changes in the air flow delivered to the spray apparatus and to the turbine itself. More particularly, a variation in the delivered air flow results in smaller changes in the acceleration period and the running speed in accordance with the present invention than the changes which occur in the prior art systems.

In some electrostatic spray apparatus, the air flow to the apparatus is divided between the spray cap and the energy conversion system. Thus, the prior art turbine systems were sized in accordance with an allotted consumption of air by the spray cap, and it was not possible to use different spray caps having different air consumptions in connection with a single spray apparatus. In contrast therewith, a spray apparatus having an energy conversion system in accordance with the present invention may be used with a range of spray caps and air consumptions, due to the decrease in sensitivity to air flow variations. Further, the pressure of the air flow to the spray apparatus may be increased to accommodate the spray caps of higher air consumption.

BRIEF DESCRIPTION OF THE DRAWINGS

FIG. 3 is a cross-sectional view on an enlarged scale along the line 3—3 of FIG. 1;

FIG. 4 is a perspective view of the shell housing of the energy conversion system, with parts broken away and omitted for purposes of clarity; and FIG. 5 is an end view of the shell housing as viewed from the right in FIG. 4.

DETAILED DESCRIPTION OF THE DRAWINGS

Figure 1:
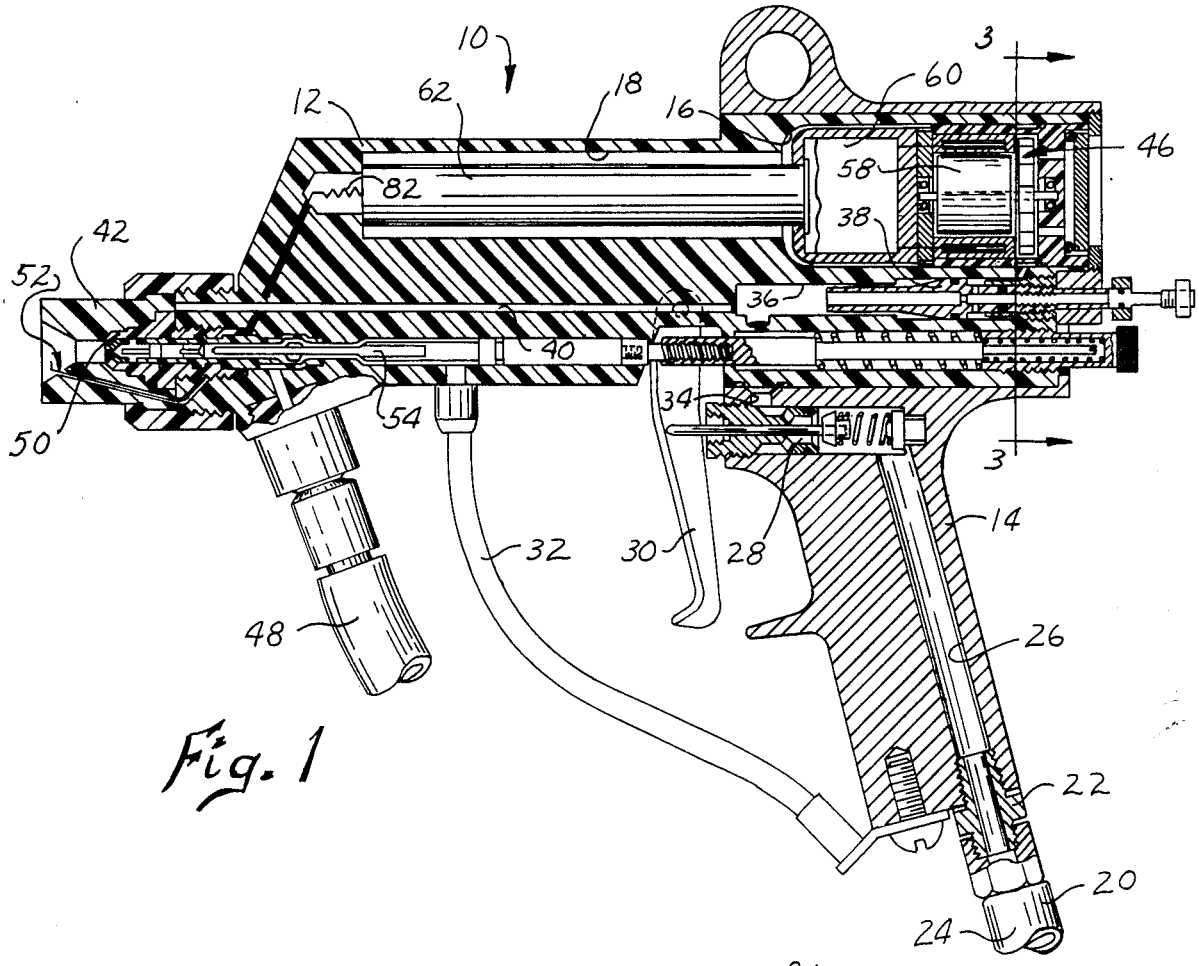
FIG. 1 is a longitudinal view, mostly in section, of a spray gun embodying the energy conversion system of the present invention.

Referring to the drawings in greater detail, there is shown a spray gun 10 which may be of the airless or hydraulically atomized type, although it is illustrated as an airless type. The gun 10 may be of the automatically operated type, but it is illustrated as the hand-manipulable type of electrostatic spray gun for spraying paint or other coating material. The spray gun includes a generally cylindrical barrel 12 of high dielectric insulating material attached to a handle 14 which is electrically grounded.

The rearward portion of the handle 14 includes a generally cylindrical chamber 16 which communicates with a smaller diameter, cylindrical chamber 18 adjacent the forward portions of the barrel.

An air hose 20 is connected, by means of a fitting 22, to the bottom of the handle 14. The hose 20 is connected to a remote source of substantially constant pressure compressed air (not shown), which may comprise a conventional, regulated compressed air supply, e.g., 60–70 psig, with a flow rate of about 2 cfm. A metallic coating 24 on the air hose 20 serves as a ground connection for the handle 14 of the gun.

An air flow conduit 26 within the handle connects to the air inlet hose 20, and the air flow through the gun is controlled by a valve 28 operated by a trigger 30. A guard 32 is provided for the trigger. The output side of the valve 28 supplies a conduit 34, which in turn supplies a manifold 36.

An air regulator 38 disposed within the manifold 36 is operable to direct the air flow from the manifold through a conduit 40 to a spray cap assembly 42 and/or through an input nozzle 44 (FIG. 2) to an energy conversion unit 46.

The spray cap assembly 42 may be conventional in nature, such as illustrated in U.S. Pat. Nos. 3,645,447 or 3,843,052. The air flow to the spray cap 42 may be used in an airless gun to improve the quality of the peripheral regions of the emitted spray fan of coating material, or it may be used in an air-atomized gun to convey the flow of compressed air to the cap assembly 42 to be used in the conventional air-induced atomization of the coating material.

The coating material is introduced from a remote supply source and supplied through a coating material hose 48 to a spray tip 50. The cap assembly 42 includes a conventional electrode 52. The spraying of the coating material is regulated by operation of the trigger 30, which in turn controls a needle valve 54.

The energy conversion unit 46 includes as its primary components a turbine 56 which is directly connected to an alternator 58. The output of the alternator is passed to a transformer 60 and the output signal of the transformer is in turn passed to a voltage multiplier 62.

The energy conversion unit 46 is mounted within a shell housing 64 (FIG. 2), and an intermediate housing 66 mechanically secures the housing 64 to the multiplier 62. Accordingly, the housings 64 and 66 cooperate with the multiplier 62 to provide a cartridge which is received within the cylindrical chambers 16 and 18 of the spray gun 10.

Figure 2:
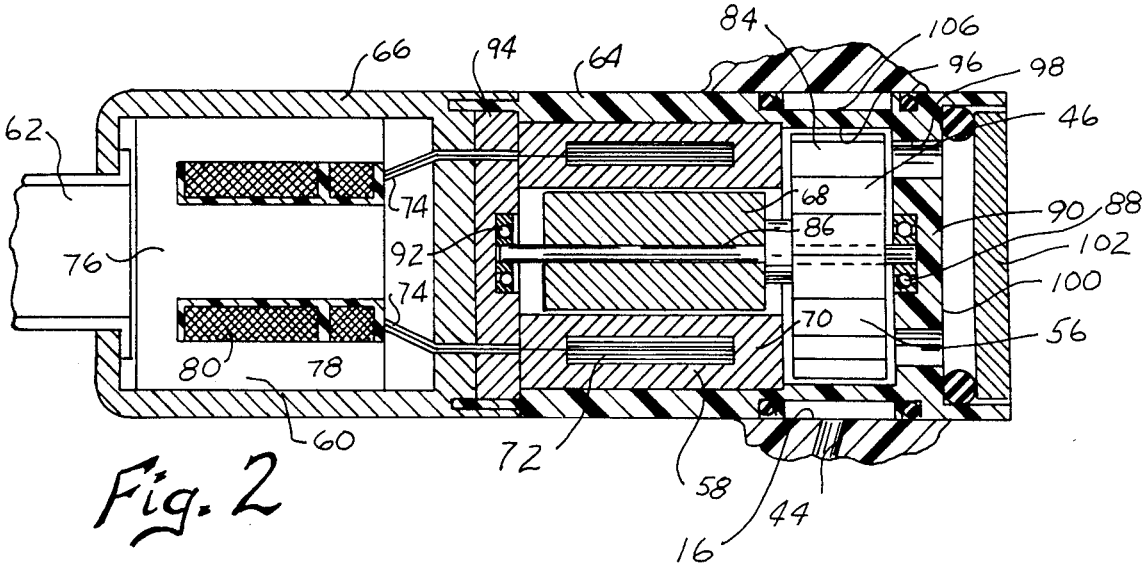
FIG. 2 is an enlarged, longitudinal, sectional view of the energy conversion system and immediately adjacent electrical components.

Referring to FIGS. 1 and 2, the electrical components of the spray gun are briefly described. The alternator 58 includes a rotor 68 which is driven by the turbine 56. The rotor 68 is a permanent magnet, magnetized transversely, and may be a four-pole or may be a two-pole, as illustrated. The alternator 58 includes a magnetically permeable stator 70, with at least one stator winding 72 having leads 74 passing to the transformer 60.

The transformer 60 has a suitable magnetically permeable core 76 with a primary winding 78 connected to the stator winding 72. The transformer also includes a step-up secondary winding 80.

The voltage multiplier 62 is of the series or cascade half-wave rectifier typoe of long-chain or ladder-type multiplier. The multiplier may include 20 to 24 stages, with each stage including a capacitor and a diode. The output from the multiplier 62 comprises a high-voltage, preferably a negative voltage, which is supplied through a limiting resistor 82 (FIG. 1) to the electrode 52 for charging the atomized particles of coating material.

Referring to FIGS. 2 through 5, the energy conversion unit 46 is shown in greater detail. The turbine 56 includes a rotor or turbine wheel 84 which is secured to a shaft 86. The alternator rotor 68 is also secured to the shaft. The shaft is journaled between high-speed bearings 88 mounted in a fixed end wall 90 of the housing 64 and high-speed bearings 92 mounted in a removable end wall 94 of the housing.

The rotor 84 is of lightweight construction; for example, it may be made of high strength plastic such as Delrin and provided with a diameter of about 2.5 cm and thickness of about 0.6 cm. The rotor 84 has a ratchet wheel shape and the teeth are slightly truncated, as best shown in FIG. 3. The rotor is mounted in a chamber 96 located adjacent the rearward end of the shell housing 64. The rotor is sized so as to substantially fill the chamber 96.

The drive air is exhausted from the chamber 96 through eight symmetrically positioned exhaust holes 98 (FIG. 5) extending through the end wall 90. The exhausted air is received within the muffler manifold 100, and from there it is passed through a perforated muffler disc 102 to the atmosphere. The muffler disc 102 may be sintered, ceramic or porous metal disc to permit the exhaust of the air to the atmosphere and to act as a muffler. The muffler disc may seal the exhaust manifold 58 by means of an O-ring 104.

The supply of pressurized air is delivered to the energy conversion unit 46 through input nozzle 44, which communicates with an annular air distribution chamber 106. The chamber 106 is defined by an annular recess 108 extending about the exterior of the shell housing 64 and the adjacent surface portion of the cylindrical chamber 16, as best shown in FIGS. 2 and 4. A fluid-tight seal is assured by O-rings 110 located on opposite sides of the chamber 106.

Referring to FIGS. 3 and 4, a drive port 112 and a brake port 114 extend through the wall of the shell housing 64 within the base of the annular recess 108 to direct impinging air flows on the rotor 84 of the turbine 56. As shown in FIG. 3, the drive direction of the rotor 84 is in a counterclockwise direction in accordance with the flow of drive air through the port 112. On the other hand, the flow of brake air through the port 114 impinges upon the rotor 84 and biases rotation thereof in a clockwise direction.

The dimensions of the port 112 are larger than those of the port 114 and, accordingly, the flow of drive air through the port 112 is greater than the flow of brake air through the port 114. In the illustrated embodiment, the port 112 has a diameter of 0.063 inch and the port 114 has a diameter of 0.0465 inch. Accordingly, the ratio of the cross-sectional area of the drive port to that of the brake port is about 2.

The flow of air through the input nozzle 44 and into the chamber 106 is tangentially directed and has a counterclockwise flow direction, as shown in FIG. 3. The drive port 112 is oriented so as to not reverse the direction of the flow of air as it passes from the chamber 106 into the port 112. It has been found that the drive port 112 is preferably located about 15 to 20 degrees downstream from the input nozzle 44. Consistent with the foregoing parameters, the port 112 is also oriented to direct the drive air along a chordal path intersecting the rotor 84 at substantially right angles to each of the drive surfaces **84*a* of the rotor and at generally central locations along such surfaces. In FIG. 3**, the direction of flow of the drive air is indicated by the line "D".

The brake port 114 is positioned downstream of the port 112, and it is oriented to require reversal of the direction of air flow in the chamber 106 as the air passes into the port 114. The port 114 is also oriented to cause the flow of brake air to impinge upon the brake surfaces **84*b*. Each brake surface 84*b* is disposed in a chordal plane spaced from the center of the rotor and perpendicular to the plane of the abutting drive surface 84*a*. As shown in FIG. 3, the rotor is symmetrical with each drive surface 84*a* being of the same size and each brake surface 84*b* being of the same size. The area of the brake surfaces 84*b* is greater than the area of the drive surfaces 84*a***.

The direction of flow of the brake air is indicated by the line "B". As shown in FIG. 3, it has been found empirically that the directions of the flows of the drive air and the brake air should intersect at an enclosed angle of about 19° degrees on the side of the rotor remote from the ports 112 and 114. The flows of drive and brake air impinge the rotor on opposite diametrical sides thereof in order to bias the rotor in opposite directions of rotation.

In the operation of the spray gun 10, the trigger 30 is arranged to initially open the valve 28 to cause pressurized air to flow to the energy conversion unit 46. Thus, the turbine 56 is brought up to speed and an appropriate electrostatic spray potential is supplied to the electrode 52 in about one second or less and at about the same time the continued actuation of the trigger 30 operates the needle valve 54 to permit the passage of coating material and the commencement of the spraying operation.

In the illustrated gun, the air flow into the chamber 106 is directed by the port 112 into impingement with the rotor 84 and instantaneous acceleration is achieved. The braking air flow through the port 114, or at least the contrary rotational biasing effects thereof, are not believed to be fully effective until the acceleration period is substantially complete. This is believed due in part to the fact that air flow through the port 114 is more dependent upon establishing an equilibrium pressure within the chamber 106 which is greater than the pressure within the chamber 96. On the other hand, flow through the port 112 is codirectional with the air flow through the chamber 106 and the port 112 is closer to the input nozzle 44. In addition, the port 112 is arranged to provide rapid, successive impulse driving of the rotor 84 by impingement forces primarily applied to the drive surfaces 84a. Thus, the acceleration process is characterized by highly turbulent conditions which tend to minimize the effects of the brake flow to the port 114. In contrast, the steady running condition tends to be more affected by the disruptive effects of the flow of brake air through the port 114.

Using a 60 psig supply of pressurized air, the spray gun can achieve a 50,000 rpm running speed in one second or less. The air consumption is about 2 cfm. Upon increasing the supply pressure to 70 psig, the period of acceleration remains at one second or less, and the running speed increases to about 53,000 rpm. Accordingly, a 6% increase in running speed results upon increasing the pressure of the air supply about 17%. In contrast with this stabilized performance, prior art spray apparatus having a single drive air port and flow of impinging air upon the rotor were found to display about a 30% variation in running speed when subjected to similar changes in the pressure of the air supply.

Operation of the illustrated spray gun at 60 psig results in a running speed in the order of 51,000 to 52,000 rpm, and air consumption of about 2.13 cfm. Modification of the spray gun to close the brake port 114 results in a decrease in the air consumption to a value of 1.875 cfm and a running speed of about 70,000 rpm, which is destructive of the electrical components in the spray gun.

The illustrated spray cap 42 has a characteristic air consumption determined by the size of the air cap, and the air regulator 38 is adjusted to provide the desired air flow. In accordance with the present invention, the spray gun 10 is useful with spray caps having air consumption rates ranging from 8 cfm to 18 cfm. To accommodate the spray caps having high air consumption rates, the supply of air to the gun will be increased and, typically, a pressure increase of from 60 psig to 70 psig will be imposed upon the gun. This increase in pressure is accommodated by the energy conversion unit 46 with only a moderate increase in the running speed of the turbine 56. (As noted above, an increase of about 3,000 rpm will result.) The variations in running speed of the turbine 56 are of a magnitude such that the corresponding variations in the electrostatic potential and spraying operation are not visually perceivable or significant in respect to the characteristics of the resulting coating.

In summary, the present invention provides an improved technique and apparatus for effecting energy conversion in a spray apparatus having a self-contained primary energy conversion system. In accordance with the invention, the rotor of the air turbine is impinged by judiciously sized and directed flows of drive air and brake air. Cooperatively, the flows of drive and brake air have been found to enable desirable acceleration periods of about one second or less and subsequent steady state running speeds of values lower than those previously associated with such rapid acceleration periods. These improvements are obtained in an admirably simple technique using apparatus substantially free of moving, valve-type elements.

It should be evident that this disclosure is by way of example and that various changes may be made by adding, modifying or eliminating details without departing from the fair scope of the teaching contained in this disclosure. The invention is therefore not limited to particular details of this disclosure except to the extent that the following claims are necessarily so limited.

What is claimed is:

1. An electrostatic spray coating apparatus including means for emitting a spray of coating material and electrode means for applying an electric charge to the emitted coating material, and an energy conversion assembly for converting the energy of a fluid under opressure into electrical energy for use in said spray apparatus, said assembly including a turbine operably connected to a generator for providing an electrical output, said turbine having a rotor adapted to be pneumatially operated by pressurized air delivered to the spray apparatus from a remote supply thereof, said assembly also including pneumatic drive means and pneumatic brake means cooperatively arranged to accelerate said rotor from rest to a predetermined running speed in a predetermined time interval, said pneumatic drive means comprising a first air stream arranged to drive said turbine in a first rotational direction and said pneumatic brake means comprising a second air stream arranged to drive said turbine in an opposite second rotational direction, said streams of air cooperatively accelerating and maintaining the rotation of said rotor in said first direction, said first and second air streams being derived from a common chamber to which pressurized air is delivered at a constant pressure, said common chamber having an annular configuration and extending around said rotor.

2. An electrostatic spray apparatus as set forth in claim 1, wherein said first and second air streams respectively flow through a drive port and a brake port, each of said ports having an intake end open to said common chamber and an output end adjacent said rotor.

3. An electrostatic spray apparatus as set forth in claim 2, wherein the ratio of the cross-sectional area of said drive port to that of said brake port is about 2.

4. An electrostatic spray apparatus as set forth in claim 1, wherein said turbine rotor has a ratchet wheel configuration including a plurality of radially extending teeth disposed about its periphery and each of said teeth has a drive surface upon which said first air stream is primarily impinged and a brake surface upon which said second air stream is primarily impinged.

5. An electrostatic spray apparatus as set forth in claim 4, wherein said first stream of air impinges each of said drive surfaces at substantially a right angle upon rotation of said rotor.

6. An electrostatic spray apparatus as set fourth in claim 4, wherein said drive surfaces have an area less than that of said brake surfaces.

7. An electrostatic spray apparatus as set forth in claim 1, wherein said first stream of air impinges said rotor on a first diametrical side thereof and said second stream of air impinges said rotor on a second opposite diametrical side thereof.

8. An electrostatic spray apparatus as set forth in claim 7, wherein said first and second streams of air respectively pass along first and second flow directions, and said flow directions intersect at an angle of about 19° on the side of the rotor remote from said streams of air.

9. An electrostatic spray coating apparatus including means for emitting a spray of coating material and electrode means for applying an electric charge to the emitted coating material, and an energy conversion assembly for converting the energy of a fluid under pressure into electrical energy for use in said spray apparatus, said assembly including a turbine operably connected to an alternator for providing an electrical output, said turbine having a rotor adapted to be driven by impinging drive and brake air flows, said drive air flow being arranged to bias said rotor in a first direction of rotation and said brake air flow being arranged to bias said rotor in an opposite second direction of rotation, said air flows cooperatively causing rotation of said rotor in said first direction of rotation, said air flow being derived from a common chamber to which supply air is delivered at a constant pressure, said common chamber having an annular configuration and extending around said rotor.

10. An electrostatic spray apparatus as set forth in claim 9, wherein said drive air flow has a volume about twice the volume of said brake air flow.

11. An electrostatic spray apparatus as set forth in claim 9, wherein said supply air is delivered to said common chamber through a supply port tangentially disposed with respect to said common chamber to cause directional air flow therein.

12. An electrostatic spray apparatus as set forth in claim 11, wherein said assembly includes a drive port and a brake port through which said drive and brake air flows respectively pass, each of said ports having an intake end open to said common chamber and an output end adjacent said rotor.

13. An electrostatic spray apparatus as set forth in claim 12, wherein said intake end of said drive port is in the range of about 15° to about 20° downstream from said supply port in the direction of flow of said supply air within said common chamber.

14. An electrostatic spray apparatus as set forth in claim 13, wherein said drive port is arranged to direct said drive air flow in a first direction and said brake port is arranged to direct said brake air flow in a second direction, said ports are located on the same side of said rotor, and said first and second directions intersect at an acute angle on the side of the rotor remote from said ports.

15. An electrostatic spray apparatus as set forth in claims 9 or 14, wherein said rotor has a ratchet wheel configuration including a plurality of radially extending teeth disposed about its periphery, and each of said teeth has a drive surface upon which said drive air flow primarily impinges and a brake surface upon which said brake air flow primarily impinges.

16. An electrostatic spray apparatus as set forth in claim 15, wherein said drive surface has an area smaller than the area of said brake surface.

17. An electrostatic spray apparatus as set forth in claim 15, wherein said apparatus comprises a hand-manipulable spray gun.

* * * * *